US006046422A

United States Patent [19]

Renz et al.

[11] Patent Number: 6,046,422

[45] Date of Patent: Apr. 4, 2000

[54] VACUUM INTERRUPTER WITH A VAPOR SHIELD ASSOCIATED WITH THE INSULATOR

[75] Inventors: Roman Renz; Klaus Gessner, both of Berlin, Germany

[73] Assignee: Siemens Aktiengesellschaft, Munich, Germany

[21] Appl. No.: 09/328,018

[22] Filed: Jun. 8, 1999

[30] Foreign Application Priority Data

Jun. 12, 1998 [DE] Germany ..... 198 26 766

[51] Int. Cl.[7] ..... H01H 33/66

[52] U.S. Cl. ..... 218/134; 218/139

[58] Field of Search ..... 200/304; 218/118, 218/121, 134–139, 155

[56] References Cited

U.S. PATENT DOCUMENTS

| | | | |
|---|---|---|---|
| 3,231,704 | 1/1966 | Jacobs | 200/144 |
| 4,593,164 | 6/1986 | Bialkowski et al. | 200/144 B |
| 4,614,850 | 9/1986 | Kuhl et al. | 200/144 B |
| 4,746,777 | 5/1988 | Bialkowski et al. | 200/144 B |
| 5,206,616 | 4/1993 | Stegmuller | 335/126 |
| 5,847,347 | 12/1998 | Schwarze et al. | 218/139 |

FOREIGN PATENT DOCUMENTS

| | | | |
|---|---|---|---|
| 36 28 174 | 2/1988 | Germany | H01H 33/66 |
| 195 10 850 | 7/1996 | Germany | H01H 33/66 |

*Primary Examiner*—Michael Friedhofer
*Attorney, Agent, or Firm*—Kenyon & Kenyon

[57] ABSTRACT

A vacuum interrupter is provided. The vacuum interrupter includes a housing part that surrounds contact members and a vapor shield associated with the insulator, the housing part and the vapor shield are designed as one piece. A transition from the housing part to the vapor shield is undulated, so that a linear contact with one end face of the insulator results.

2 Claims, 1 Drawing Sheet

VACUUM INTERRUPTER WITH A VAPOR SHIELD ASSOCIATED WITH THE INSULATOR

FIELD OF THE INVENTION

The present invention relates to electrical switches, specifically the design of a vacuum interrupter that can be used as a switching element in low-voltage contactors.

BACKGROUND INFORMATION

One conventional vacuum interrupter for low-voltage contactors has a dual-pole contact arrangement and a housing that surrounds this contact arrangement. The dual-pole contact arrangement in turn has one stationary and one movable contact member and one power-supplying bolt for each contact member, with which the housing is connected in a vacuum-tight manner. The housing has a tubular metallic housing part that surrounds both contact members and is soldered with the power-supplying bolts of the stationary contact member. Furthermore, the housing has a hollow cylindrical insulator whose first end face is soldered to the metallic housing part, and finally an expansion bellows, which is soldered to the second end face of the insulator and to the power-supplying bolts of the movable contact member. In order to protect the inner surface of the ceramic insulator against metal vapor deposits and thus guarantee the internal insulating strength of the vacuum interrupter, a tubular vapor shield is associated with the insulator, whose one end is provided with a flange-type rim, which is also soldered to the first end face of the insulator (German Patent 195 10 850 C1).

In a conventional vacuum switch chamber for medium-voltage switches, there are two control shields in addition to a vapor shield. The control shields cover the internal rim of a ceramic cylinder at the end of the ceramic cylinder. For this purpose, the front of the ceramic cylinder is offset inward, and the vapor shield is secured by face soldering on the radial offset surface located behind the ceramic cylinder face. The control shield can be designed in one piece with the respective cover and be made of a deep-drawn stainless steel part for this purpose (German Patent Application 36 28 174 A1).

SUMMARY

An object of the present invention is to simplify the manufacture of such a vacuum interrupter, while providing increased manufacturing reliability.

To achieve this object, according to the present invention, the tubular housing part is designed as a hollow cylinder in one piece with the vapor shield, the transition from the tubular part to the tubular shield region having a smaller diameter being undulated so that one crest or valley of the undulation is in linear contact with the first end face of the insulator.

With such a design of the vacuum interrupter, the metallic housing part and the vapor shield form a one-piece component, which can be easily manufactured by deep drawing, which simplifies the assembly of the vacuum interrupter and, due to the linear contact with the insulator, provides a high degree of reliability with respect to hermeticity and minimum voltage differences in the solder area. The one-piece housing/vapor shield part is advantageously made of copper for this purpose.

DETAILED DESCRIPTION

Figure 1:
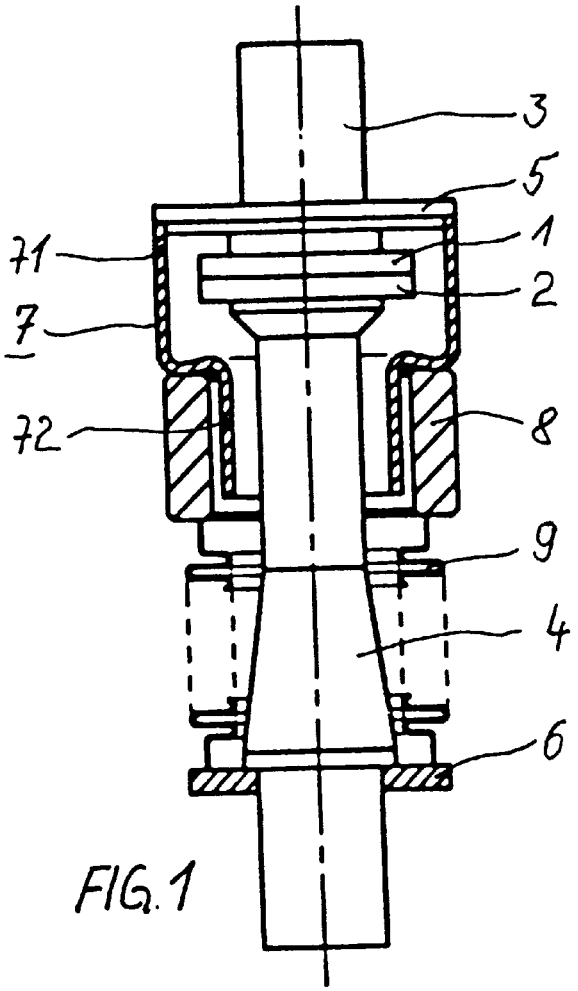
FIG. 1 shows the complete structure of a vacuum interrupter according to the present invention.

The vacuum interrupter of FIG. 1 has two contact members 1 and 2, one of which is arranged at the end of a stationary power-supplying bolt 3 and the other one is arranged at the end of a movable power-supplying bolt 4. The contact arrangement is surrounded by a housing composed of metallic housing part 71, hollow cylindrical ceramic insulator 8 and expansion bellows 9. Hollow cylindrical metallic part 71 surrounds the contact area of both contact members 1 and 2, and ceramic insulator 8 and expansion bellows 9 surround power-supplying bolts 4 of movable contact member 2. Stationary power-supplying bolt 3 is provided with an annular flange 5, to which hollow cylindrical housing part 71 is butt soldered.

Figure 2:
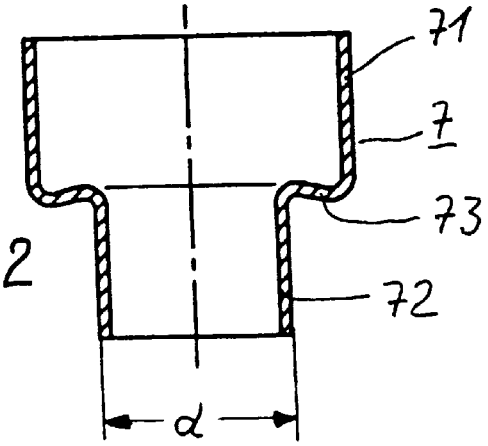
FIG. 2 shows the one-piece component forming the metallic housing part and the vapor shield according to the present invention.

Metallic housing part 71 forms a single piece with vapor shield 72, which is associated with hollow cylindrical insulator 8. Vapor shield 72 has a smaller diameter d than metallic housing part 71. A transition zone 73, which is undulated according to FIG. 2, is provided for the one-piece design with housing part 71. The valley of this undulation is in contact with the first end face of insulator 8, resulting in linear contact and thus a linear soldering zone.

One end of expansion bellows 9 is soldered to the second end face of insulator 8 and the other end is soldered to an annular flange 6 arranged on power-supplying bolt 4.

What is claimed is:

1. A vacuum interrupter, comprising:

a contact arrangement including a stationary contact member and a movable contact member, each of the stationary contact member and the movable contact member including a respective power-supplying terminal;

a housing surrounding the contact arrangement and being connected to the respective power-supplying terminal of the stationary contact member and the respective power supplying terminal of the movable contact member in a gas-tight manner, the housing including a tubular metallic housing part, a hollow cylindrical insulator, and an expansion bellows, the housing part surrounding the stationary contact member and the movable contact member, the housing part being soldered to the power-supplying terminal of the stationary contact member, the housing part being a hollow cylinder forming a single continuous piece with a tubular vapor shield, a transition from the housing part to the vapor shield having a smaller diameter than a diameter of the housing part, the insulator having a first end face soldered to the housing part, the transition being undulated so that one of a crest and a valley of the undulation is in linear contact with the first end face of the insulator, the one of the crest and the valley being soldered to the first end face of the insulator, the expansion bellows being soldered to a second end face of the insulator and soldered to the power-supplying terminal of the movable contact member.

2. The vacuum interrupter according to claim 1, wherein the single continuous piece formed by the housing part and the vapor shield is made of copper.

* * * * *